US006134095A

United States Patent [19]

May et al.

[11] Patent Number: 6,134,095

[45] Date of Patent: Oct. 17, 2000

[54] AC CORONA CHARGER FOR AN ELECTROSTATOGRAPHIC REPRODUCTION APPARATUS

[76] Inventors: John W. May; Dean R. Smith; David M. Zacher; Bonnie A. Maye; Dennis A. Kenyon; Martin J. Pernesky, all of Eastman Kodak Company, 343 State St., Rochester, N.Y. 14650

[21] Appl. No.: 09/213,848

[22] Filed: Dec. 17, 1998

[51] Int. Cl.[7] ..... H05F 3/00

[52] U.S. Cl. ..... 361/225; 361/233; 361/235

[58] Field of Search ..... 361/225, 226, 361/233, 235; 399/170–171

[56] References Cited

U.S. PATENT DOCUMENTS

| | | | |
|---|---|---|---|
| 3,527,941 | 9/1970 | Culhane et al. . | |
| 3,797,927 | 3/1974 | Fotland et al. . | |
| 4,096,543 | 6/1978 | Kozuka et al. | 361/230 |
| 4,228,480 | 10/1980 | Benwood et al. | 361/235 |
| 4,285,025 | 8/1981 | Nishikawa | 361/230 |
| 4,320,956 | 3/1982 | Nishikawa et al. . | |
| 4,386,837 | 6/1983 | Ando . | |
| 5,025,155 | 6/1991 | Hattori . | |
| 5,105,330 | 4/1992 | Hiwada | 361/225 |
| 5,642,254 | 6/1997 | Benwood et al. . | |
| 5,839,024 | 11/1998 | May et al. | 399/89 |

*Primary Examiner*—Michael J. Sherry
*Attorney, Agent, or Firm*—Lawrence P. Kessler

[57] ABSTRACT

A particularly configured aperiodic grid for a grid-controlled AC corona charger for uniformly charging a dielectric member, of an electrostatographic reproduction apparatus, moving along a travel path in operative relation to the corona charger. The corona charger includes an insulating housing and an electrically biased grid, in which the grid transparency is larger than a nominal transparency at the upstream edge of the charger grid, transparency is nominal at the center of the grid, and transparency is smaller than nominal at the downstream edge of a charger grid. The invention, which has been demonstrated for negative primary charging, preferably uses a trapezoidal AC waveform having a DC offset for corona excitation, and may be practiced over a large range of process speeds. The invention is also practiced using trapezoidal waveforms having negative duty cycles in the range 50% (conventional AC) to 90% (negative DC). The range of the variation in grid transparency from the upstream grid edge to the downstream grid edge is far greater than in prior art commercial machines.

13 Claims, 7 Drawing Sheets

AC CORONA CHARGER FOR AN ELECTROSTATOGRAPHIC REPRODUCTION APPARATUS

FIELD OF THE INVENTION

The invention relates in general to corona chargers for electrostatographic reproduction apparatus or the like, and more particularly to a grid for an electrostatographic reproduction apparatus AC corona charger which greatly improves uniformity of charging by such charger.

BACKGROUND OF THE INVENTION

Typical commercial reproduction apparatus include electrostatographic process copier-duplicators or printers, inkjet printers, and thermal printers. With such reproduction apparatus, pigmented marking particles, ink, or dye material (hereinafter referred to commonly as marking or toner particles) are utilized to develop an electrostatic image, of information to be reproduced, on a dielectric (charge retentive) member for transfer to a receiver member, or directly onto a receiver member. The receiver member bearing the marking particle image is transported through a fuser device where the image is fixed (fused) to the receiver member, for example, by heat and pressure to form a permanent reproduction thereon.

A primary charging device is typically used to uniformly charge a dielectric member before the dielectric member is exposed to an imaging light pattern. The primary charging device may be for example a corona charging device including several members, such as one or more parallel thin wires to which high voltage is applied, a housing partially surrounding the wires and open in a direction facing a dielectric member surface, and an electrically biased grid. A conductive (metallic) housing is used for DC charging (i.e., applied high voltage is DC), and an insulating (plastic) housing is typically used for AC charging (i.e., applied high voltage is AC). A grid includes a metallic screen or mesh, mounted between the corona wire(s) and the dielectric member, and is DC-biased for both DC and AC charging. Use of a grid improves control of the voltage that a primary charger imparts to the dielectric member. Use of a grid also gives a resultant dielectric member voltage uniformity that is generally better than without a grid.

When using a DC charger having high voltage DC applied to the corona wire(s), if the residence time of a moving dielectric member surface passing under a gridded charger is long compared to a characteristic time constant given by the product of the effective charging resistance and the capacitance of the dielectric member under the charger, the voltage on the dielectric member will asymptotically approach a cut-off voltage equal to the DC grid bias plus an overshoot voltage determined by grid transparency, grid/dielectric member spacing and corona voltage. For tight grids (relatively low transparency) the cut-off of the charging current is very close to the grid bias; that is, the overshoot is small. Conversely, for open grids (relatively high transparency) the overshoot can be significant. For a typical grid, the overshoot can be in the range 100–200 volts, depending on the grid to dielectric member spacing, with smaller overshoots for larger spacings.

For an AC charger in which a waveform comprising high voltage AC plus low voltage DC is applied to the corona wire(s), the cut-off voltage is generally close to the grid bias, and is only weakly dependent on the grid transparency. The actual cut-off voltage is determined by the relative efficiencies of negative and positive corona emissions during the negative and positive AC voltage excursions. Moreover, a high duty cycle trapezoidal AC waveform can be used, as disclosed in U.S. Pat. No. 5,642,254 (issued Jun. 24, 1997, in the names of Benwood et al). In this patent, the cut-off voltage is also dependent on duty cycle, and the cut-off voltage steadily approaches a DC value if duty cycle is steadily increased from 50% (conventional AC) to 100% (DC).

Presently, a variety of gridded chargers are used in typical reproduction apparatus engines. Examples of grid designs include a continuous wire filament wound back and forth across a charger opening, grids (typically photoetched) mainly composed of thin parallel members that run parallel to or at an angle to the corona wire(s), and hexagonal opening mesh pattern grids. These different types of grids are applied in various types of corona chargers, for example single or multiple corona wire chargers, pin coronode chargers, chargers with insulating or conducting housings, and chargers that use AC or DC corona voltage. There are grids that are planar and grids that are curved to be concentric with a drum dielectric member.

One exemplary family of reproduction apparatus (the Eastman Kodak IS 110™ and Ektaprint 3100™) uses a primary charger that has three corona wires powered by an AC trapezoidal voltage waveform with a DC offset, an insulating housing, and a planar tensioned grid comprised mainly of thin members that run parallel to the corona wires. The percent coverage of the grid varies in a direction perpendicular to the axis of the thin grid members (i.e., in the direction of motion of the dielectric member). The "upstream" side of the grid (the first to charge the moving dielectric member) has a percent coverage of 14.2% (transparency 85.8%), and the percent coverage increases gradually towards the "downstream" side of the grid to a percent coverage of 16.3% (transparency 83.7%). A varying coverage grid design such as this is termed "aperiodic." The aperiodicity is clearly very small for the primary charger grids; i.e., the transparency is reduced by only 2.4% from the upstream edge to the downstream edge.

In U.S. Pat. No. 3,527,941 (issued in 1970, in the names of Culhane et al), there is described the use of an aperiodic grid for primary charging. The grid includes thin parallel members whose spacing is largest on the upstream side and decreases towards the downstream side. The charger also includes a grounded conducting housing. While no quantitative range of preferred aperiodicity is mentioned, it is disclosed that the spacing of the grid members is "very great" on the upstream side. The stated advantage is to give a more rapid charge than is possible with aperiodic grid. No specific reference is made in this patent as to whether this patent is directed to DC or AC charging, but it inferentially refers to DC charging only. This can be seen in column 3, lines 29–31, which states that "where there is a high leakage, the dielectric member will tend to be charged to the potential on the corona wires". Inasmuch as the time-averaged potential from the purely AC component of an AC waveform applied to corona wires is zero, the aforementioned quote makes no sense unless it refers to DC charging. Furthermore, since the time-averaged potential of an AC waveform having a DC offset is equal to the DC offset itself, then the DC offset would have to be impracticably large to correspond to the specifications of this patent. Finally, the patent predates the usage of AC primary charging technology, so that references therein to high potentials applied to corona wires implicitly refer to DC, rather than AC, high potentials.

In U.S. Pat. No. 5,025,155 (issued Jun. 18, 1991, in the name of Hattori), there is described the use of a grid on a DC charger that is positioned so that the grid directly under the downstream-most wire is closer to the dielectric member than the grid under the upstream wire(s). In this patent (see particularly column 6, lines 1617, FIG. 5 and FIG. 8), the grid in at least one embodiment comprises two sections, with the upstream section being more transparent than the downstream section, the downstream section being also closer to the dielectric member drum. However, the patent subsequently recites that the first section (upstream) has finer openings than the downstream section. The stated advantage is that a given dielectric member voltage can be obtained at a lower corona voltage than for a standardly located charger with a constant transparency grid.

U.S. Pat. No. 4,386,837 (issued Jun. 7, 1983, in the name of Ando) discloses the use of two sequential DC chargers (e.g., chargers #1 and #2) of different polarities having a common grid potential. The grid potential is opposite in polarity to a pre-existing voltage on a dielectric member drum on the upstream side of both chargers. Charger #1 reverses the pre-existing voltage and charges the dielectric member film member to a voltage of higher magnitude but of the same polarity as the grid. Charger #2 reduces this voltage magnitude but does not reverse it, producing an exit voltage on the dielectric member drum that is close to the grid potential. In one modification, the grid of each of the chargers #1 and #2 becomes gradually less transparent in the direction of rotation of the drum, with the stated advantage being that charging is more rapid at the entrance to each charger and less rapid but more controlled in uniformity at the exit from each charger. The stated result is a uniform charging to an exit voltage close to that of the grid potential, and of the same polarity. This patent does not disclose preferred ranges of aperiodicity for either charger, nor is any uniformity improvement produced by the invention quantified.

In U.S. Pat. No. 3,797,927 (issued Mar. 19, 1974, in the names of Takahashi et al), there is disclosed a mechanism for producing a latent image on a dielectric member involving simultaneous charge and expose of the dielectric member using a gridded charger, with the distance between parallel grid wires decreasing in the direction of motion of the dielectric member and the stated advantage (column 5, lines 35–36) of "gradualization of the equalization of the surface charges". A DC simultaneous charge and expose device is disclosed (column 5, lines 33–35, FIG. 3*a*') as well as an AC device (column 6, lines 14–16, FIG. 4*a*'). This patent does not disclose preferred ranges of aperiodicity for either charger, nor is any uniformity improvement produced by the invention quantified.

U.S. Pat. No. 4,320,956 (issued Mar. 23, 1982, in the names of Nishikawa et al) discloses, in FIG. 7*b*, a charger grid that is less transparent at the end portions; i.e., resulting in aperiodicity in a direction at right angles to the direction of travel of a dielectric member under the charger.

As mentioned above, a charger's resultant dielectric member voltage uniformity is generally improved by the use of a grid. However, for any corona charger design, charging uniformity tends to decline over the life of a charger due to the buildup of contamination on the corona wire members. To maintain acceptable image quality, corona wire members must be periodically replaced, which causes machine downtime and generates service costs. There is, therefore, a need to increase the running time for a charger before maintenance is required. There is also a need to improve the uniformity of charging for copiers and printers, especially for high quality color electrostatographic imaging. There is also yet a further general need to improve uniformity of charging for higher throughput speeds in copiers and printers.

These needs are especially pertinent in the context of AC charging technology. There is an ongoing commercial trend to replace prior art DC charging with AC charging, particularly for negative charging, because of ever increasing demands for improved image quality. It is well known in the art that AC negative charging is much superior to DC negative charging, because AC negative charging gives substantially more uniform charge laydown on a dielectric member than negative DC.

SUMMARY OF THE INVENTION

In view of the above, this invention is directed to use of a particularly configured aperiodic grid for a grid-controlled AC corona charger for uniformly charging a dielectric member, of an electrostatographic reproduction apparatus, moving along a travel path in operative relation to the corona charger. The corona charger includes an insulating housing and an electrically biased grid, in which the grid transparency is larger than a nominal transparency at the upstream edge of the charger grid, transparency is nominal at the center of the grid, and transparency is smaller than nominal at the downstream edge of a charger grid. The invention, which has been demonstrated for negative primary charging, preferably uses a trapezoidal AC waveform having a DC offset for corona excitation, and may be practiced over a large range of process speeds. The invention is also practiced using trapezoidal waveforms having negative duty cycles in the range 50% (conventional AC) to 90% (negative DC). The range of the variation in grid transparency from the upstream grid edge to the downstream grid edge is far greater than in prior art commercial machines.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
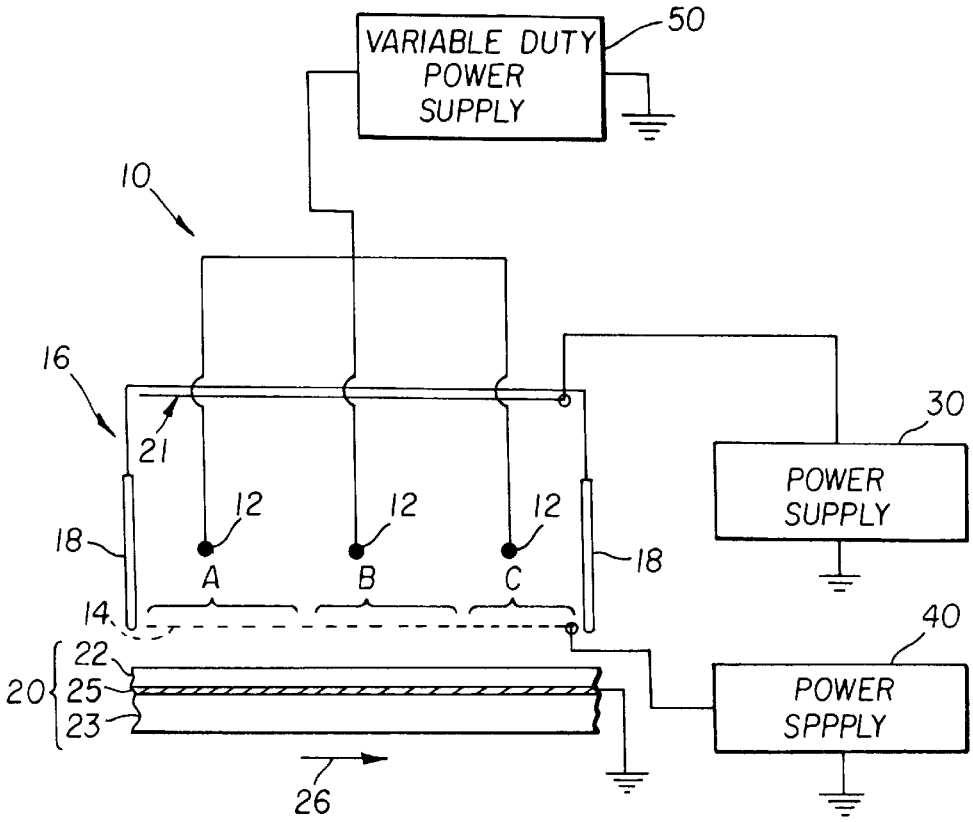
FIG. 1 is a schematic view of a high duty cycle AC corona charger having aperiodic grid according to the present invention.

Referring now to the accompanying drawings, a variable duty cycle AC charger, referred to in general by number 10, is shown schematically in FIG. 1. Charger 10 has corona wires 12, a grid 14, and a shell 16. The shell 16 defines a housing having an opening directed toward the surface of a dielectric member 20 for an electrostatographic reproduction apparatus of an well known type. The side walls of the shell may be incomplete, and extended with side shields 18. Side shields 18 and shell 16 are preferably constructed of insulating plastic. Side shields 18, when employed, end at a preselected distance from the surface of the dielectric member 20. The dielectric member includes, for example, a photosensitive layer 22, a grounded conductive layer 25, and a base support layer 23. The dielectric member, in the configuration of a continuous web, is transported in a direction, indicated by arrow 26, passed the charger 10 in operative relation therewith during the reproduction process (described above).

A conductive floor electrode 21, connected to a power supply 30, is located between shell 16 and corona wires 12. Of course, such conductive floor electrode 21 is not essential for the practice of the invention. A power supply 40 is electrically coupled to the grid 14 to maintain the potential of grid at any preselected level. For example, the grid voltage may be set at −600V, however this value depends on the geometry of the charger, components used in the charger, and the charging requirements. Further, the particular aperiodic configuration of the grid 14, according to this invention, is described in detail hereinbelow.

A variable duty cycle power supply 50 generates a high voltage AC signal applied to the corona wires 12. The duty cycle of the AC voltage signal applies to corona wires 12 is greater than approximately 50% and preferably less than approximately 90%, regardless of the polarity of charging. A duty cycle of 80% has been found to yield excellent results. A typical value of the AC voltage signal is ±8,000 volts, at 500 Hz. Again, this voltage and this frequency may be varied depending on other operating specifications and components. For example, frequency may be in the range of approximately 60 Hz to 6,000 Hz and voltage may be in the range of 5,000 volts to 12,000 volts. The potential on the corona wire is greater than a threshold voltage for corona emission for each polarity. The AC component of the voltage signal applied to the corona wires has a trapezoidal waveform, although other waveforms may be useful in the practice of the invention. Of course, other corona charger devices, utilizing pin coronodes, sawtooth electrodes or knife-edge electrodes and the like in place of corona wires, are suitable for use with this invention.

To demonstrate this invention, while the grid 14 of the charger 10 is an aperiodic grid of a particular configuration, the corona charger is otherwise identical to a standard commercial corona wire charger of an Eastman Kodak IS 110 Copier/Duplicator reproduction apparatus. Comparison tests of charger performance were then made using a standard Eastman Kodak IS 110 Copier/Duplicator primary charger in order to show the improved charging uniformity due to the aperiodic grid according to this invention.

Experimental procedure

The aperiodic grid 14, according to this invention, used in the described experiments has thin parallel members running in the cross-track direction (parallel to the corona wires 12). These thin members are 0.010" wide in the in-track direction (parallel to the motion of the dielectric member under the charger designated by arrow 26). The grid is about 2.4" wide in-track and is divided into three approximately equal sections, each about 0.8" wide in-track. Grid transparency (percent of opening allowing the passage of electrical charge) is larger than a nominal transparency at the upstream edge of the charger grid, transparency is nominal at the center of the grid, and transparency is smaller than nominal at the downstream edge of the grid. In the upstream section (designated by the letter A), the in-track spacing between the thin members is 0.080"; in the center section (designated by the letter B), it is 0.050"; and in the downstream section (designated by the letter C), it is 0.020". The grid may be formed in any suitable manner, such as being photoetched from stainless steel for example.

As described above, the primary corona charger 10 has three corona wires 12 energized by the variable duty power supply 50, for example at 600 Hz by an AC trapezoidal waveform having a DC offset voltage that is equal to a preset DC grid voltage. The grid voltage effectively controls the surface potential of the dielectric member 20 at the exit of the primary charger 10. The power supply 50 for the corona charger 10 provides a constant rms emission current.

A well known problem associated with corona wire primary chargers is aging of the corona wires, caused by the gradual buildup of surface contamination compounds, e.g., silica, on the surfaces of the wires. Buildup of this contamination results in increased charging impedance, as well as a serious impairment of charging uniformity. In the Eastman Kodak IS 110 Copier/Duplicator reproduction apparatus, a wiper mechanism on the primary charger is periodically actuated to clean the corona wires and the inner surface of the grid of the primary charger at regular copy intervals. A primary cause of contamination of chargers is the reaction of highly reactive chemical species, created in corona emissions, with fuser oil vapors carried to a charging station by air circulation inside a machine.

Pre-aging of the corona wires allows demonstration of maximum benefit of the invention. The corona charger used in this test was pre-aged by running it in a fixture which exposed it to high levels of fuser oil vapor. During the aging time, the wires and grid were mechanically wiped at periodic intervals a total of 32 times inside this fixture, using the charger's wiping apparatus in order to simulate aging in a machine. At the end of the pre-aging, the nonuniformity of the prints produced by this charger was similar to that of a charger, operating in a commercial machine, that is close to needing to have the corona wires replaced (charger life of at least 200,000 prints).

Charging performance of the corona wire charger of an Eastman Kodak IS 110 Copier/Duplicator reproduction apparatus was checked in two ways: flat field density prints were made, and a dielectric member voltage scan was done.

Figure 2:
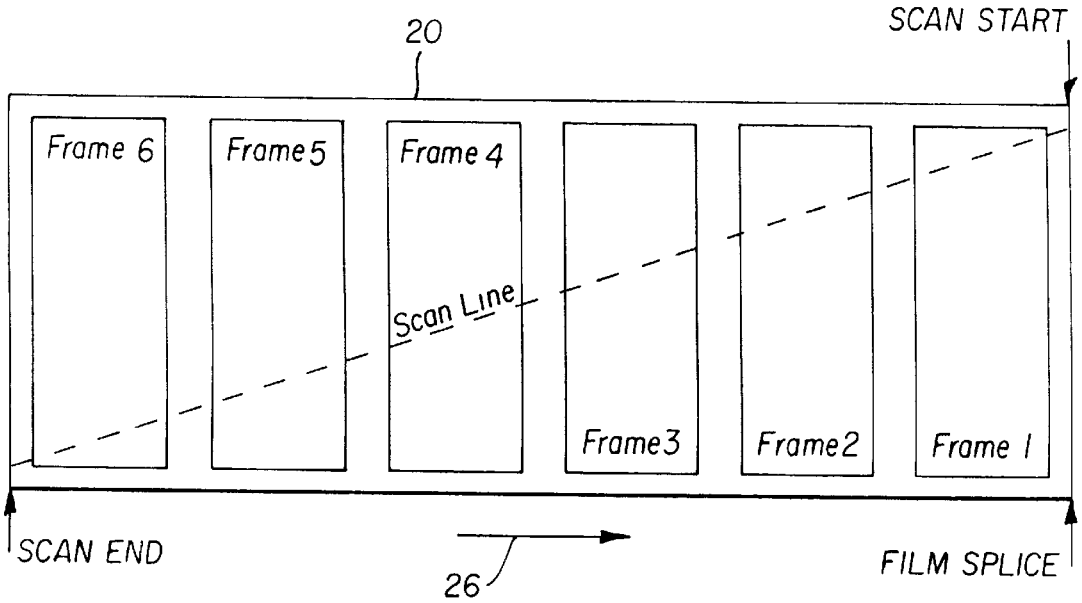
FIG. 2 schematically illustrates the voltage scan trace across a dielectric member over one transport cycle of the dielectric member.

Voltage scans were performed using an electrostatic voltmeter probe located immediately downstream of the primary charger to measure the post-charging dielectric member voltage. This probe was translated across the width of the dielectric member belt (cross-track) in the time taken for one complete revolution of the dielectric member belt (in-track). The resultant voltage scan traces a diagonal path across all six frames of the dielectric member belt (see FIG. 2). The analog signal from the probe was passed through an anti-aliasing filter and sampled by a computerized data acquisition system. The sampling frequency used permits spatial voltage fluctuations with wavelengths greater than or equal to 1.6 mm along the diagonal to be resolved. This spatial resolution roughly matches the maximum spatial resolution measurable by the electrostatic voltmeter probe. In separate tests using a stationary probe, the dielectric member voltage measured in the in-track dimension only was much more uniform than in the cross-track dimension, which had significant variation. Hence, in the tests demonstrating the invention, voltage variations measured by the probe along its diagonal trace were almost entirely caused by cross-track variation.

Once a sampled voltage trace was acquired, it was filtered digitally to separate out the low frequency components of the voltage variation having wavelengths above about 30 mm, and the high frequency components having wavelengths below 30 mm. Standard deviations are reported here for the raw data and for the high-pass filtered data only. It has been found that the standard deviation of the high-pass filtered data usually agrees with a subjective rating of the image quality of prints, so this is used as the primary metric of charging uniformity. The low frequency components themselves do not usually contribute much to an observer's perception of image quality, except for large scale banding in very large solid area portions of an image, and therefore the low-pass filtered data is not reported separately. Of course the raw data contain these components, and it is shown in the results below that the invention also provides significant improvements, not only for the high frequency information, but also for the entire measurable spatial frequency range. Note that standard deviation is used, rather than some normalized standard deviation (such as the standard deviation divided by the mean) because it is standard protocol to run all charger performance tests with a dielectric member voltage close to −600V.

In the reproduction apparatus for the corona wire charger of an Eastman Kodak IS 110 Copier/Duplicator, there are primary charger rails mounted that serve two purposes: they form part of an ozone removal system, and they help guide the insertion of the primary charger. Since the sides of the primary charger housing are quite open, these rails tend to effectively close up the sides of the charger, though they are located at a small distance away from the open sides. In the modified reproduction apparatus for the corona wire charger of an Eastman Kodak IS 110 Copier/Duplicator used here, these rails were removed, leaving the sides of the charger open. Because of this, some charging current tends to "leak" out the side of the charger; i.e., reaches the dielectric member 20 without having to pass through the grid 14, so this portion of the current is not controlled by the grid. For some of the aperiodic grid tests, it was desired to have all the charging current controlled by the grid, and for these tests, insulating plastic side shields 18 were added to the charger. The side shields were attached without any gap at the bottom, and terminated approximately 1 mm from the plane of the grid 14. Comparison tests were made without the side shields in place, to ascertain the effect of these shields.

Four grid/side shield configurations were tested: the standard grid (as a control) with and without side shields on the corona charger, and the aperiodic test grid with and without side shields on the charger. The corona charger 10 was set up in a reproduction apparatus (in this experiment, in an Eastman Kodak 2110 Copier/Duplicator) so that the grid-to-dielectric member spacing for all configurations was 0.060". For each configuration, performance was measured with the standard corona voltage waveform (600 Hz AC square wave, 50% duty cycle, with a DC offset) as well as at 60%, 70%, 80%, and 90% (negative) duty cycle. Negative duty cycle, as reported here, refers to a rectangular wave AC signal from a low voltage HP 3314A function generator, which is used to drive a Trek 20/20 high voltage amplifier to provide high voltage AC excitation to the corona wires. A given negative duty cycle defines a fraction of one period of the rectangular waveform output of the function generator for which the polarity is negative. For example, 60% negative duty cycle means that the waveform has negative polarity sixty percent of the time and positive polarity 40% of the time. The actual high voltage waveform from the Trek 20/20 was approximately trapezoidal, as described in the aforementioned U.S. Pat. No. 5,642,254. The DC offset of the corona excitation waveform was held constant at −600V for all experiments at every duty cycle. The power supply 40 for the grid 14 was a Trek 677A DC power supply.

It was desired to set up the power supply 50 at 50% duty cycle to function as closely as possible to the above noted Eastman Kodak 2110 Copier/Duplicator reproduction apparatus power supply, and then to use the Trek for a duty cycle series for each configuration. A Trek 20/20 is a constant voltage power supply, whereas the corona charger power supply for the Eastman Kodak 2110 Copier/Duplicator reproduction apparatus is a constant current supply that provides a predetermined rms emission current. For each grid/side shield configuration in the examples below, the operating current of the charger at 50% duty cycle was made to be similar to the current in the Eastman Kodak 2110 Copier/Duplicator reproduction apparatus. To accomplish this, a grid/side shield configuration under test was run in the Eastman Kodak 2110 Copier/Duplicator reproduction apparatus using a standard machine corona supply, with rms emission current set to its standard value of 1.6 ma, and the grid voltage (supplied by the Trek 677A) adjusted to give a dielectric member voltage of −600V. Then the corona charger power supply was switched to the power supply 50 (i.e., the Trek 20/20 amplifier fed by the HP 3314A function generator), and the peak-to-peak AC component of the corona voltage was adjusted until $V_{zero}$ (the output voltage on the dielectric member) was −600V. Peak-to-peak voltage was then held constant at this value for the remainder of the test of that particular grid/side shield configuration (i.e., for all duty cycles). The full test of a particular configuration was run as quickly as possible, to preclude as much as possible a change in corona charging current caused by a change in ambient conditions (e.g., barometric pressure). As duty cycle was increased, $V_{zero}$ was controlled by adjusting the DC level of the grid bias in order to keep $V_{zero}$ within about 5 volts of −600V. That is, in addition to keeping the peak-to-peak voltage the same for all duty cycles, the mean charging current for a given process speed was also kept constant (the same charge delivered to the dielectric member in the same charging time); i.e., the mean charging current was proportional to process speed. In all of the tests, the cleaner in the reproduction apparatus was disabled (the extra aging associated with the tests was negligible).

Each grid/side shield configuration was tested (for all the duty cycles) at the standard process speed for the Eastman Kodak 2110 Copier/Duplicator reproduction apparatus of almost 18 in/sec, at a process speed of 9 ips, and at a process speed of 4.5 ips. The Trek 20/20 peak-to-peak voltage, set up as described above, was kept constant over all the test speeds. For each grid/side shield configuration in the Eastman Kodak 2110 Copier/Duplicator-reproduction apparatus, the corona voltage was set up at 50% duty cycle, as described above, for any one of the process speeds tested. Then 12 prints and a voltage trace were made for all combinations of duty cycles and speeds.

While the most preferred modes of the invention are disclosed following the examples below, other modes may be different, depending on the duty cycle and the process speed of the desired application. As an illustrative example of a different mode of charging, the corona charger device may have a plurality of single wire chargers, each with their own housing and grid. The single wire chargers may be located in succession with respect to the travel path of the dielectric member, and the successive grids would be of decreasing transparency in the travel direction.

In the examples, the corona charger with side shields includes a standard charger housing having extended (higher) plastic walls, as described above. The charger without side shields includes a standard charger housing, as described above. The phrase "standard grid" refers to the prior art aperiodic grid of the corona charger for the Eastman Kodak IS 110 Copier/Duplicator reproduction apparatus, while the phrase "segmented grid" refers to the prior art aperiodic grid according to this invention as described above. The standard deviation (σ) of $V_{zero}$ is reported as "raw" for unfiltered data from voltage scans (see FIG. 2), and as "filtered" for data high-pass filtered as described above. The three process speeds studied in the examples, namely 4.5 ips, 9 ips and 18 ips are respectively referred to as "low", "medium" and "high" speeds.

EXAMPLE 1

With Side shields

In this example, standard and segmented grids are compared, using side shields. The presence of the side shields effectively prevents direct line of sight between the upstream and downstream corona wires and the dielectric member surface.

TABLE 1

| | With Side Shields Raw σ ($V_{zero}$) (volts) | | | | | |
|---|---|---|---|---|---|---|
| Duty Cycle (%) | Standard 18 ips | Segmented 18 ips | Standard 9 ips | Segmented 9 ips | Standard 4.5 ips | Segmented 4.5 ips |
| 50 | 10.59 | 5.35 | 9.76 | 3.50 | 10.99 | 6.01 |
| 60 | 11.35 | 6.29 | 11.08 | 4.35 | 12.85 | 6.30 |
| 70 | 12.52 | 7.97 | 12.35 | 6.47 | 14.70 | 6.56 |
| 80 | 13.06 | 16.20 | 12.55 | 9.29 | 14.12 | 7.90 |
| 90 | 15.70 | 23.98 | 14.70 | 22.62 | 15.88 | 22.55 |

TABLE 2

| | With Side Shields Filtered σ ($V_{zero}$) (volts) | | | | | |
|---|---|---|---|---|---|---|
| Duty Cycle (%) | Standard 18 ips | Segmented 18 ips | Standard 9 ips | Segmented 9 ips | Standard 4.5 ips | Segmented 4.5 ips |
| 50 | 4.96 | 2.46 | 3.27 | 0.81 | 2.83 | 1.00 |
| 60 | 5.04 | 2.97 | 3.82 | 0.92 | 3.55 | 0.96 |
| 70 | 5.55 | 4.03 | 4.68 | 1.89 | 3.67 | 1.04 |
| 80 | 6.34 | 9.34 | 4.74 | 3.51 | 3.10 | 1.83 |
| 90 | 7.83 | 14.08 | 6.39 | 10.88 | 6.47 | 7.10 |

Both raw and filtered standard deviations (σ) of $V_{zero}$ are reported as functions of duty cycle for both standard and segmented grids, with side shields, in Tables 1 and 2, and FIGS. 3–6. More attention should be paid to the filtered data, because it tends to correlate better with the image quality perceived by a viewer of an output electrostatographic print. Note that, because $V_{zero}$ is always nominally −600 volts in this example, and in all following examples, a 6 volt standard deviation (σ) is equivalent to a 1 % rms fluctuation.

Figure 3:
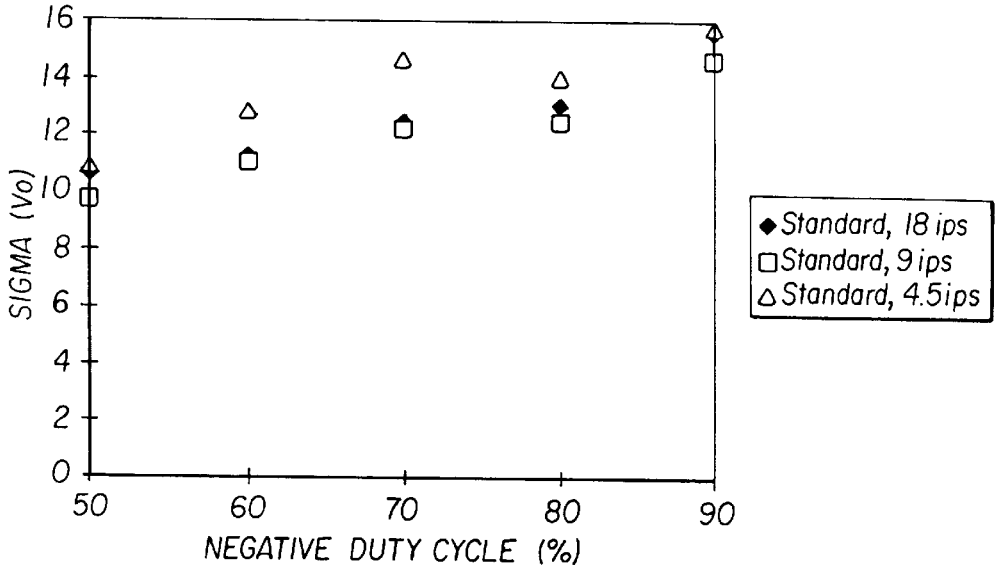
FIG. 3 is a plot of raw standard deviation against negative duty cycle, at varying process speeds, with side shields, for a standard grid.
Figure 4:
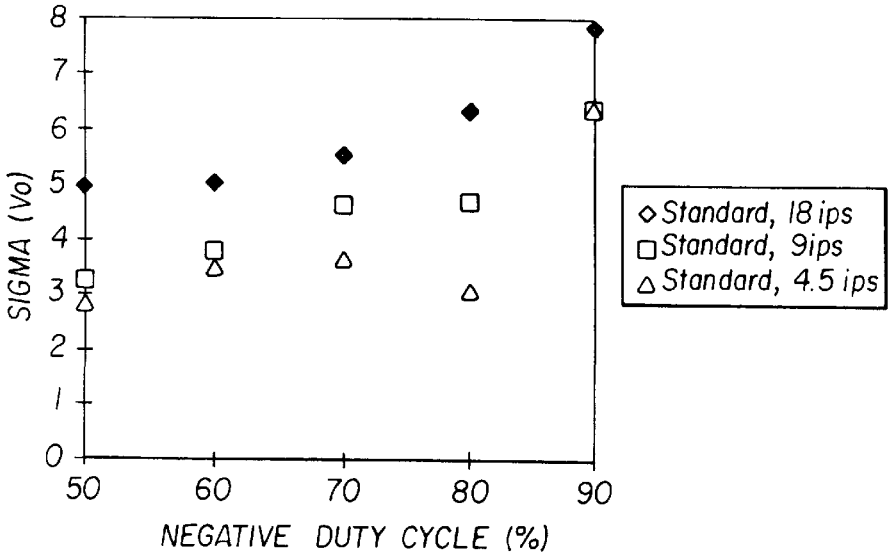
FIG. 4 is a plot of filtered standard deviation against negative duty cycle, at varying process speeds, with side shields, for a standard grid.
Figure 5:
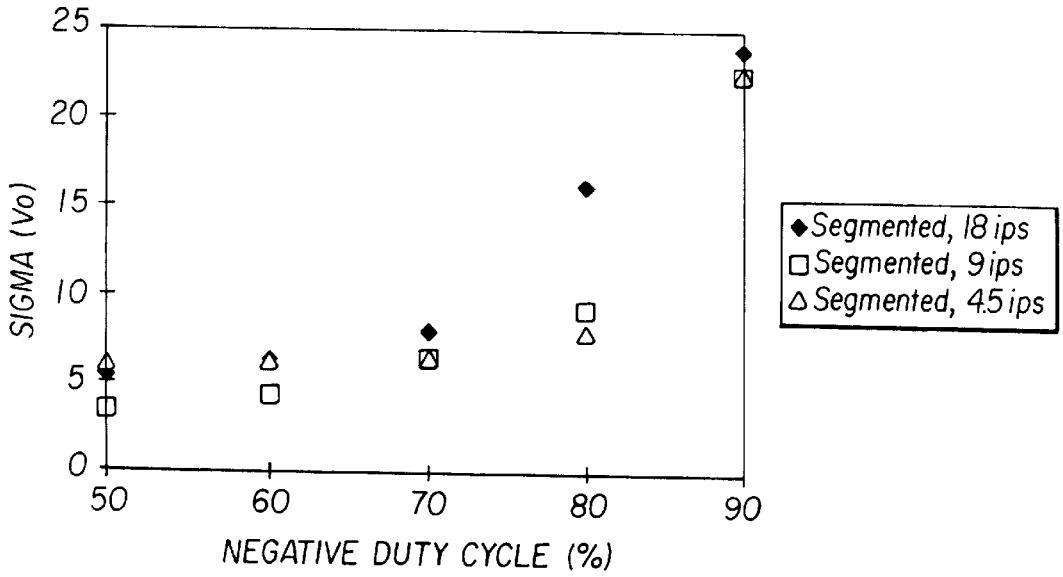
FIG. 5 is a plot of raw standard deviation against negative duty cycle, at varying process speeds, with side shields, for a segmented grid.
Figure 6:
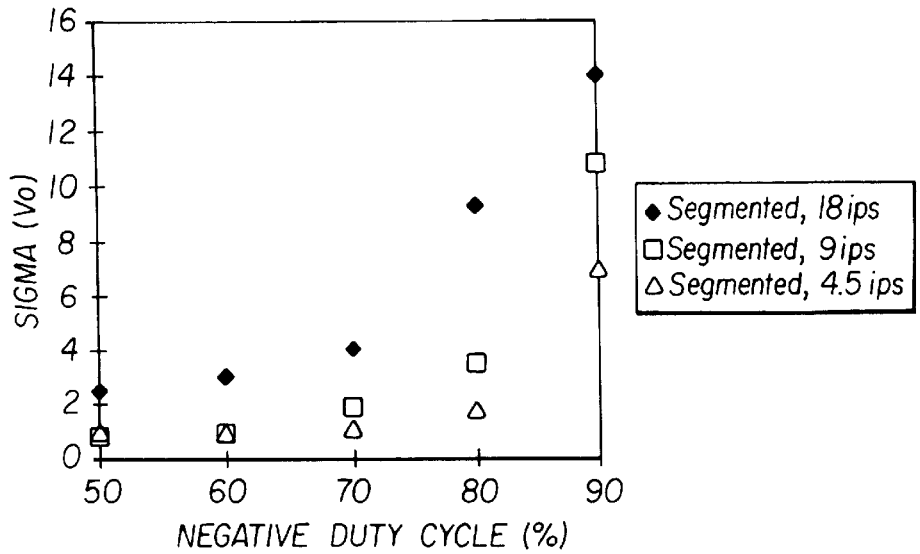
FIG. 6 is a plot of filtered standard deviation against negative duty cycle, at varying process speeds, with side shields, for a segmented grid.

For a standard grid with side shields, FIGS. 3 and 4 show that for all three process speeds, both the raw and the filtered standard deviation (σ) values become larger as negative duty cycle increases, except for a few data points which clearly deviate statistically from the general trend. For a segmented grid with side shields, FIGS. 5 and 6 illustrate similar behavior. The raw data (FIGS. 3 and 5) indicate that medium and high speeds are somewhat favored, but this may not be statistically significant. On the other hand, the filtered data (FIGS. 4 and 6) clearly show better performance at low speed, and worse performance as speed is increased. Note the great reduction of filtered standard deviation (σ) values as compared with raw standard deviation (σ) values, which is a reflection of the fact that the heavily aged corona wires used for these tests have corona emissions that exhibit considerable low spatial frequency variability.

Direct comparisons of FIGS. 3 and 5, as well as FIGS. 4 and 6, show that use of a segmented grid gives a large improvements for both raw and filtered standard deviation (σ) values for duty cycles in the range 50%–70%. At 80% duty cycle, the behavior is reversed for 18 ips (i.e., the standard grid is superior), and for 90% the behavior is reversed for all speeds.

It may be concluded from this example that with side shields in place, and for all process speeds studied in the range of 4.5 ips to 18 ips, a segmented grid is preferred for duty cycles in the range 50%–70%. A standard grid is preferred for 80% duty cycle at 18 ips, and also for 90% duty cycle at all speeds.

EXAMPLE 2

Without Side Shields

In this example, standard and segmented grids are compared, using a standard charger housing without added side shields. The absence of the side shields allows some direct line of sight between the upstream and downstream corona wires and the dielectric member surface. Both raw and filtered standard deviations (σ) of $V_{zero}$ are reported as functions of duty cycle for both standard and segmented grids with side shields in Tables 3 and 4, and FIGS. 7–10.

TABLE 3

| | Without Side Shields Raw σ ($V_{zero}$) (volts) | | | | | |
|---|---|---|---|---|---|---|
| Duty Cycle (%) | Standard 18 ips | Segmented 18 ips | Standard 9 ips | Segmented 9 ips | Standard 4.5 ips | Segmented 4.5 ips |
| 50 | 8.14 | 10.43 | 11.32 | 6.07 | 13.76 | 10.34 |
| 60 | 9.78 | 7.66 | 14.20 | 7.25 | 17.49 | 12.98 |
| 70 | 10.18 | 7.91 | 18.58 | 9.40 | 23.28 | 16.46 |
| 80 | 12.13 | 12.57 | 19.61 | 10.50 | 27.68 | 19.87 |
| 90 | 14.70 | 17.32 | 24.32 | 20.96 | 36.85 | 27.82 |

TABLE 4

| Duty Cycle (%) | Without Side Shields Filtered σ ($V_{zero}$) (volts) Standard 18 ips | Segmented 18 ips | Standard 9 ips | Segmented 9 ips | Standard 4.5 ips | Segmented 4.5 ips |
|---|---|---|---|---|---|---|
| 50 | 3.45 | 3.01 | 3.10 | 1.41 | 2.38 | 2.08 |
| 60 | 4.84 | 2.48 | 3.97 | 2.05 | 3.37 | 3.00 |
| 70 | 4.69 | 2.95 | 4.94 | 2.80 | 4.84 | 4.12 |
| 80 | 5.34 | 4.40 | 5.60 | 3.64 | 6.76 | 5.54 |
| 90 | 7.86 | 6.59 | 8.76 | 6.90 | 10.73 | 8.65 |

Figure 7:
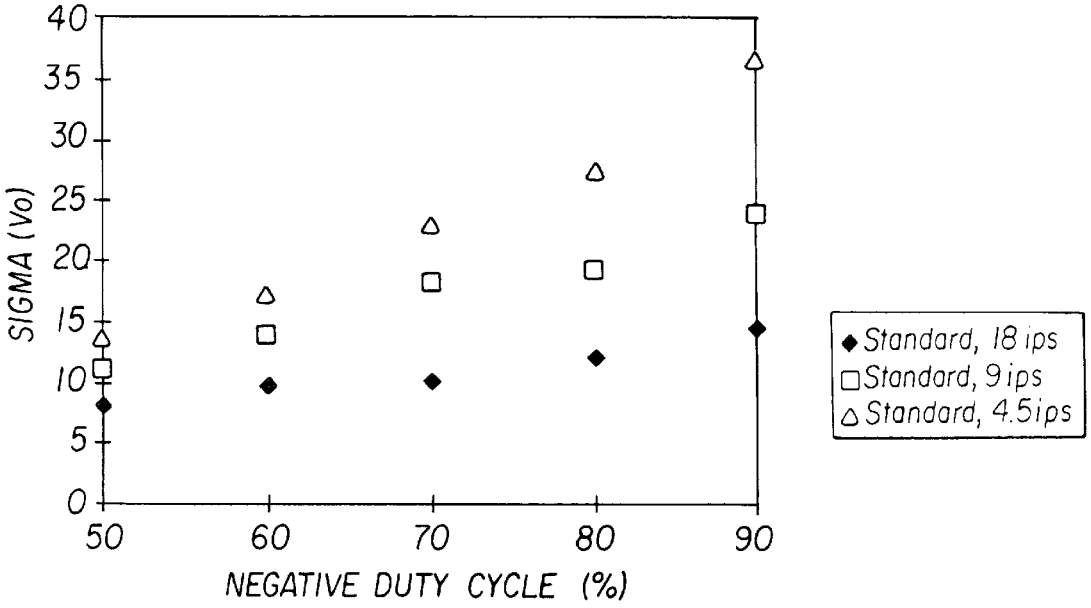
FIG. 7 is a plot of raw standard deviation against negative duty cycle, at varying process speeds, without side shields, for a standard grid.
Figure 8:
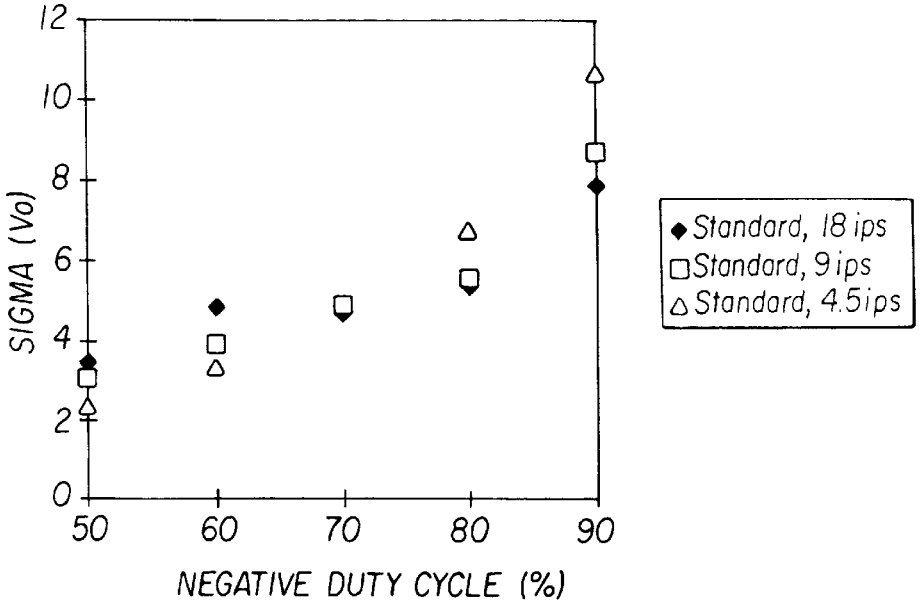
FIG. 8 is a plot of filtered standard deviation against negative duty cycle, at varying process speeds, without side shields, for a standard grid.
Figure 9:
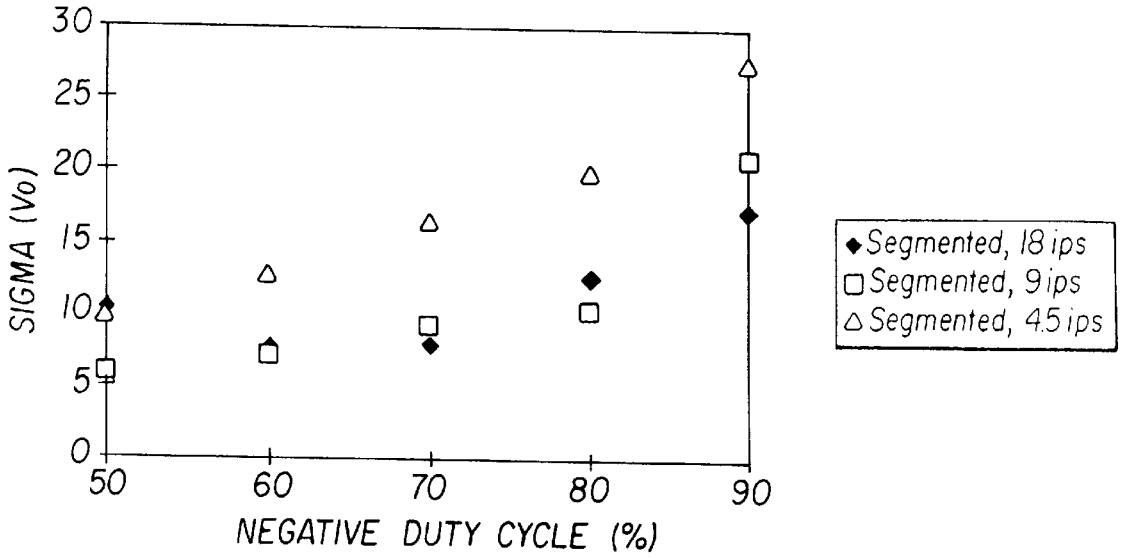
FIG. 9 is a plot of raw standard deviation against negative duty cycle, at varying process speeds, without side shields, for a segmented grid.
Figure 10:
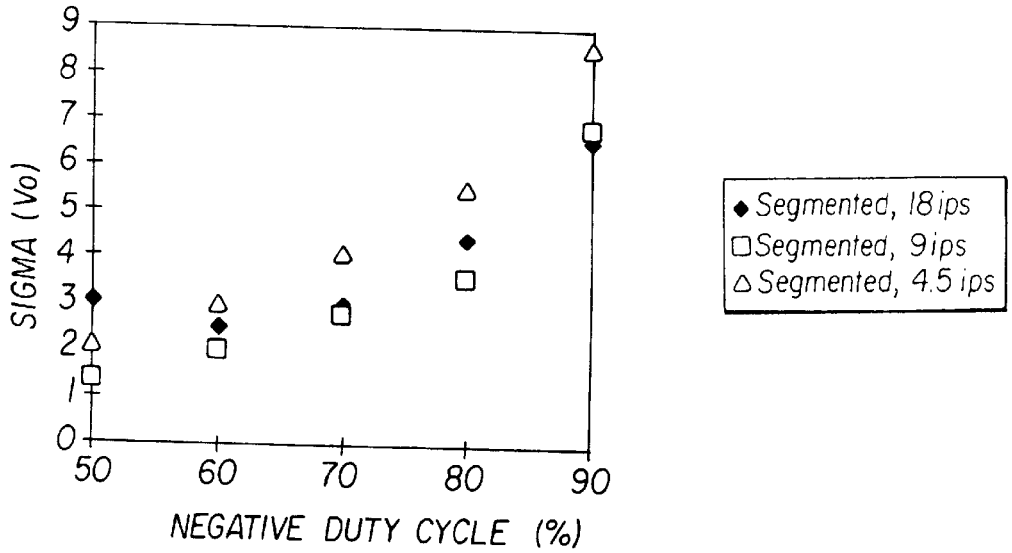
FIG. 10 is a plot of filtered standard deviation against negative duty cycle, at varying process speeds, without side shields, for a segmented grid.
Figure 11:
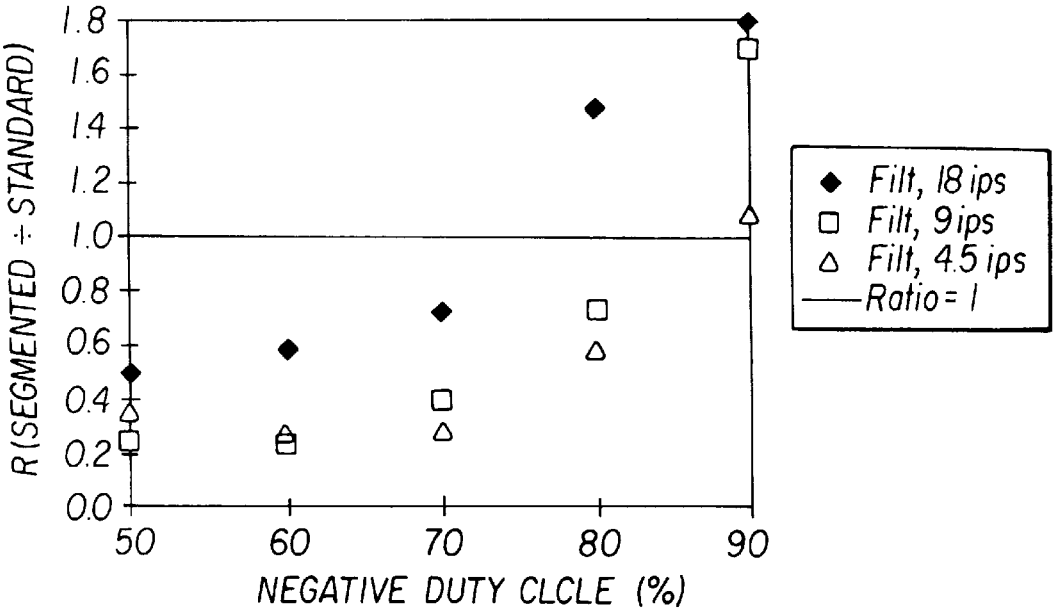
FIG. 11 is a plot of ratios of filtered standard deviation, with side shields, against negative duty cycle, at varying process speeds.
Figure 12:
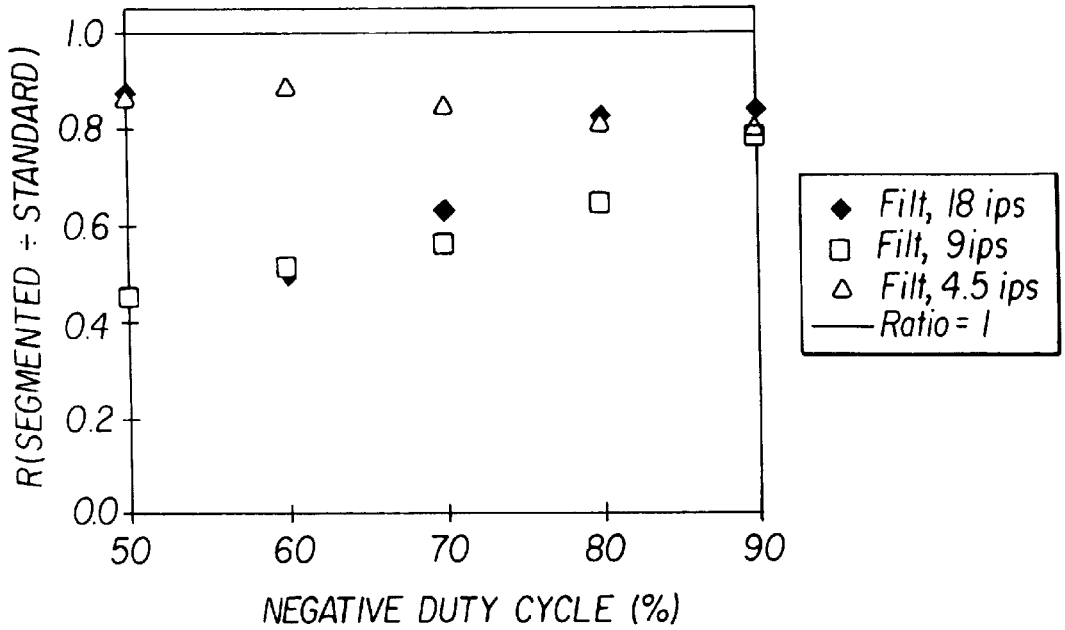
FIG. 12 is a plot of ratios of filtered standard deviation, without side shields, against negative duty cycle, at varying process speeds.

For a standard grid without side shields, FIGS. 7 and 8 show, as in Example 1, that for all three process speeds, both the raw and the filtered standard deviation (σ) values become larger as negative duty cycle increases. The raw data (FIGS. 7 and 9) indicate that medium and high speeds are more clearly favored than the comparison data in Example 1 (FIGS. 3 and 5). On the other hand, the filtered data (FIGS. 8 and 10) show little differences of performance as a function of process speed, with perhaps slightly worse performance at the slow speed, which is opposite to the data in Example 1 (FIGS. 4 and 6). Note again the great reduction of filtered standard deviation (σ) values as compared with raw standard deviation (σ) values. The effect of using a segmented grid, without side shields, versus a standard grid is shown by direct comparisons of FIGS. 7 and 9 as well as FIGS. 8 and 10. It is evident that for the raw data, a segmented grid is clearly superior over the whole range of duty cycles for the lower speeds, 4.5 ips and 9 ips, and is superior at 60% and 70% for 18 ips. On the other hand, for the filtered data, the performance with a segmented grid is superior over the whole range of duty cycle (50%–90%). For filtered data only (which correlate better with viewed prints), FIGS. 11–14 separately highlight the effects of a segmented grid compared to a standard grid, and side shields compared with no side shields. Thus, FIG. 11 plots ratios of standard deviation (σ) values (segmented÷standard) with side shields, and FIG. 12 plots ratios of standard deviation (σ) values (segmented÷standard) without side shields. In each figure, a line corresponding to a ratio of unity is shown. In FIGS. 11 and 12, all points above the unity line correspond to cases in which the segmented grid performance is inferior to the standard grid performance. It is evident that only for cases of high duty cycles with side shields does the ratio exceed unity. In all other instances, it is clear that the segmented grid improves performance.

Figure 13:
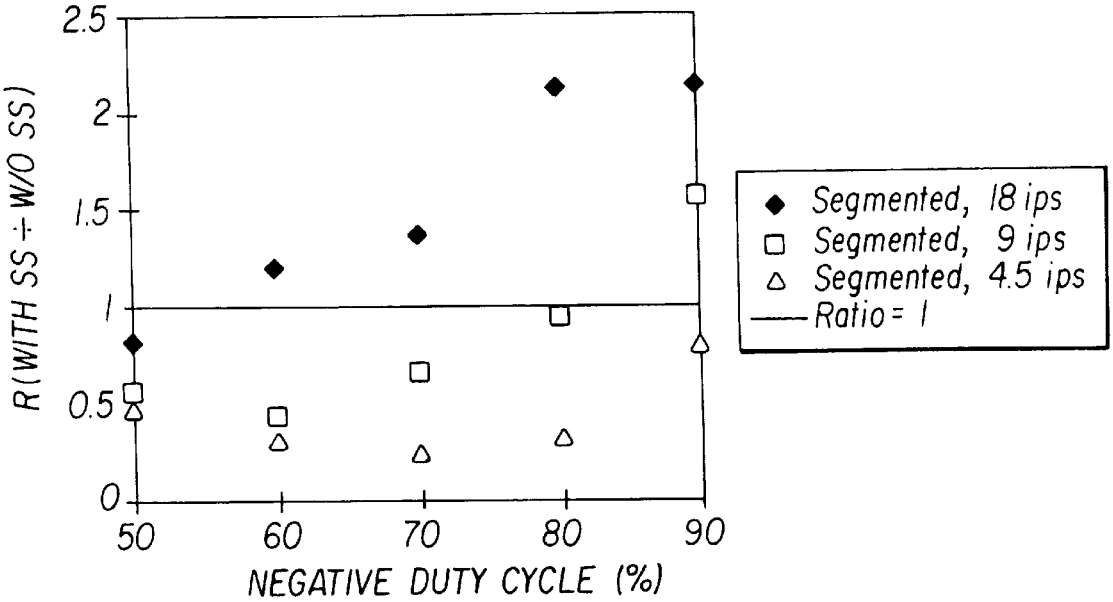
FIG. 13 is a plot of ratios of filtered standard deviation, for a segmented grid, against negative duty cycle, at varying process speeds.
Figure 14:
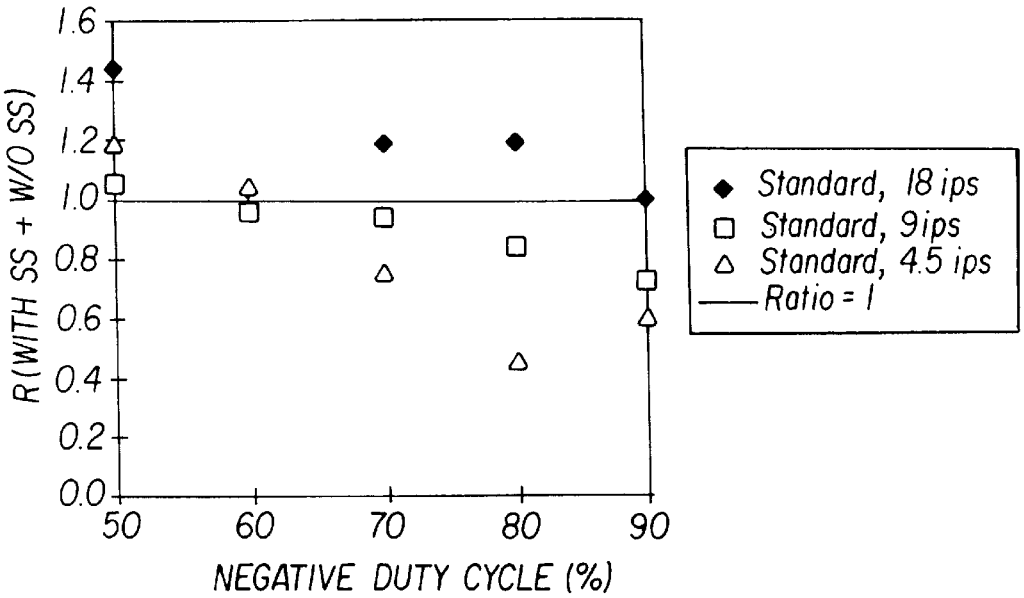
FIG. 14 is a plot of ratios of filtered standard deviation, for a standard grid, against negative duty cycle, at varying process speeds.

Turning to FIGS. 13 and 14, comparing the use of side shields versus the use of no side shields, a ratio smaller than unity favors the use of side shields, and a ratio larger than unity favors the use of no side shields. The main conclusion to be drawn from these two figures is that side shields have a deleterious effect at high process speeds, particularly when using a segmented grid.

EXAMPLE 3

Correlation with prints.

For each data point in FIGS. 3–10, a set of twelve flat-field prints was collected. Prints corresponding to a given frame on the dielectric member film belt were laid out side by side, and visually judged for image quality defects, such as in-track streaks and mottle. An excellent visual correlation was obtained between measured filtered standard deviation (σ) values and perceived image quality. Large values of raw standard deviation (σ) values also correlated with the appearance of relatively large scale banding in the prints.

As the examples demonstrate, the preferred mode of operation is dependent upon the electrostatographic application, especially the process speed. These best modes are presently constrained by the method used to control $V_{zero}$, namely, by adjusting the DC grid bias, while keeping the peak voltage of the AC component of the corona excitation waveform and the DC offset of the corona excitation waveform both constant. The choice of preferred modes is also constrained by the use of an insulating, all plastic, housing for the corona charger 10. Under these constraints, the most preferred duty cycle is 50%. Table 5 shows "more preferred" and "less preferred" modes according to this invention, based on the filtered data. The more preferred modes are for negative duty cycle in the approximate range 50%–70%, and the less preferred modes are for negative duty cycle higher than about 80%. The segmented grid is always preferred over a standard grid, for all speeds. On the other hand, for low and medium process speeds, using the more preferred modes (50%–70% duty cycle), use of side shields is most preferred, but the use of no side shields is preferred at high process speeds. Similarly, for the less preferred modifications, a preference for side shields at low process speeds gives way to a preference for no side shields at high process speeds, with no preference at medium process speeds.

TABLE 5

| Process Speed | Preferred and Less Preferred Modes: More Preferred | Less Preferred |
|---|---|---|
| Low | Segmented, with side shield, 50%–70% neg duty cycle | Segmented, with side shield, 80% neg duty cycle |
| Medium | Segmented, with side shield, 50%–70% neg duty cycle | Segmented, with side shield, 80% neg duty cycle<br>Segmented, without side shield, 80% neg duty cycle |
| High | Segmented, without side shield, 50%–70% neg duty cycle | Segmented, without side shield, 80% neg duty cycle |

In summary, the most preferred mode of the invention for all process speeds comprises 50% duty cycle and a segmented grid. Side shields provide additional benefit at low and medium speeds. Certain electrostatographic applications are primarily concerned with reliability combined with a need for a lower voltage power supply. In such a scenario, the use of a negative duty cycle greater than 50% can be preferred. The invention is practiced at higher duty cycle using a segmented grid and keeping the grid bias at, say, −600V, resulting in a lower required peak-to-peak corona AC voltage to produce the same charging current as at 50% duty cycle.

A primary advantage of the segmented grid, according to this invention, is the ability to charge a dielectric member with a corona wire charger more uniformly than prior art AC methods, over a wide range of process speeds. Another advantage is that the invention can be practiced very easily by simply replacing the existing (standard) grid of typical well known commercial reproduction apparatus. Another advantage is the ability to use a high duty cycle waveform to permit lowering of the AC peak-to-peak voltage without compromising image quality as compared to the prior art method that does not use a strongly aperiodic grid. It is evident from the examples that the invention can be advantageously practiced using process speeds well outside the range tested; i.e., in excess of 18ips, and below 4.5 ips.

The invention has been described in detail with particular reference to certain preferred embodiments thereof, but it will be understood that variations and modifications can be effected within the spirit and scope of the invention.

What is claimed is:

1. A corona charger for uniformly charging a dielectric member, of an electrostatographic reproduction apparatus, moving along a travel path in operative relation to said corona charger at a speed in the range of about 4.5 to 18 inches per second, said corona charger comprising:

an element for producing, on electrical excitation, a corona emission;

an insulating housing at least partially surrounding said element and defining an opening in a direction facing the surface of said dielectric member;

an AC power source connected to said element, which when activated serves to excite said element to produce the corona emission; and an electrically biased grid, in said opening of said housing, for controlling uniform charging of said dielectric member, said grid having a plurality of grid elements lying in a direction cross-track to the direction of travel of said dielectric member, the spacing between said grid elements decreasing substantially in the direction of travel of said dielectric member such that the upstream portion of said grid is more transparent, and the downstream portion is less transparent, and said spacing is divided into discrete steps.

2. The corona charger according to claim 1 wherein said discrete steps substantially divide said grid into thirds.

3. The corona charger according to claim 2 wherein grid transparency is larger than a nominal transparency at the upstream third of said grid, transparency is nominal at the center third of said grid, and transparency is smaller than nominal at the downstream third of said grid.

4. The corona charger according to claim 2 wherein grid transparency spacing between said grid elements is approximately 0.080" at the upstream third of said grid, transparency spacing between said grid elements is approximately 0.050" at the center third of said grid, and transparency spacing between said grid elements is approximately 0.020" at the downstream third of said grid.

5. The corona charger according to claim 4 wherein said grid is photoetched from stainless steel.

6. The corona charger according to claim 4 wherein said element for producing, on electrical excitation, a corona emission is at least one wire.

7. The corona charger according to claim 4 wherein element for producing, on electrical excitation, a corona emission is a plurality of wires.

8. The corona charger according to claim 7 wherein said AC power supply is of a high duty cycle.

9. The corona charger according to claim 7 wherein said AC power supply is of a negative duty cycle in the range of about 50% to 90%.

10. The corona charger according to claim 4 wherein said AC power supply has a DC offset.

11. The corona charger according to claim 4 wherein said AC power supply has wave form which is substantially trapezoidal.

12. The corona charger according to claim 10 wherein said AC power supply high duty cycle is a negative duty cycle greater than 50% and has a reduced peak-to-peak voltage of the AC component.

13. The corona charger according to claim 12 wherein said housing includes insulating side shields.

* * * * *